US010905155B2

(12) United States Patent
Ferrazzin et al.

(10) Patent No.: US 10,905,155 B2
(45) Date of Patent: Feb. 2, 2021

(54) METHOD AND APPARATUS FOR MANUFACTURING VARIABLE CRIMPED WEB MATERIAL

(71) Applicant: Philip Morris Products S.A., Neuchatel (CH)

(72) Inventors: Diego Ferrazzin, Castelfranco Emilia (IT); Daniele Sanna, Trebbo di Reno (IT); Daniele Guidi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 444 days.

(21) Appl. No.: 14/915,742

(22) PCT Filed: Aug. 29, 2014

(86) PCT No.: PCT/EP2014/068445
§ 371 (c)(1),
(2) Date: Mar. 1, 2016

(87) PCT Pub. No.: WO2015/028644
PCT Pub. Date: Mar. 5, 2015

(65) Prior Publication Data

US 2016/0213058 A1 Jul. 28, 2016

(30) Foreign Application Priority Data

Sep. 2, 2013 (EP) ..... 13182665

(51) Int. Cl.
*A24D 3/02* (2006.01)

(52) U.S. Cl.
CPC ..... *A24D 3/0279* (2013.01); *A24D 3/0204* (2013.01); *A24D 3/0229* (2013.01)

(58) Field of Classification Search
None
See application file for complete search history.

(56) References Cited

U.S. PATENT DOCUMENTS 37,462 A 1/1863 Seely
1,642,782 A 9/1927 Langston
(Continued)

FOREIGN PATENT DOCUMENTS

CH 691 156 A5 5/2001
CN 101089876 A 12/2007
(Continued)

OTHER PUBLICATIONS

Office Action dated Jun. 16, 2017 in corresponding Australian Patent Application No. 2014314129.
(Continued)

*Primary Examiner* — Hemant Desai
*Assistant Examiner* — Tanzim Imam
(74) *Attorney, Agent, or Firm* — Oblon, McClelland, Maier & Neustadt, L.L.P.

(57) ABSTRACT

A method of manufacturing a variable crimped web material is provided, including feeding a substantially continuous web material; crimping a first region of the material at a first crimp value; and crimping a second region of the material, adjacent the first region, at a second crimp value, the crimping using a set of two rollers, each being corrugated across at least a portion of its width and corrugated around its circumference, and being configured so the corrugations across the width interleave with each other to crimp the material, so the troughs of the corrugations around the circumference crimp the material at the first crimp value, and so the peaks of the corrugations around the circumference crimp the material at the second crimp value. An apparatus for manufacturing a crimped web material, and a method of manufacturing air flow directing elements for smoking articles are also provided.

6 Claims, 3 Drawing Sheets

(56) References Cited

U.S. PATENT DOCUMENTS

| | | | | |
|---|---|---|---|---|
| 1,954,881 | A | 4/1934 | List | |
| 2,954,036 | A | 9/1960 | Schur et al. | |
| 3,173,426 | A | 3/1965 | Touey et al. | |
| 3,180,911 | A | 4/1965 | Muller | |
| 3,383,449 | A | 5/1968 | Mueller | |
| 3,621,764 | A | 11/1971 | Muller et al. | |
| 3,849,526 | A | 11/1974 | Muller et al. | |
| 4,247,273 | A | 1/1981 | Pogrzeba et al. | |
| 4,585,016 | A * | 4/1986 | Grollimund | A24D 1/02 131/360 |
| 4,940,500 | A * | 7/1990 | Tadokoro | B01D 29/012 156/204 |
| 6,207,249 | B1 * | 3/2001 | Lencoski | B31D 5/0047 138/166 |
| 6,387,029 | B1 * | 5/2002 | Lencoski | B31D 5/0047 493/464 |
| 7,040,569 | B2 | 5/2006 | Schäfer et al. | |
| 7,476,191 | B2 * | 1/2009 | Putch | B65H 27/00 493/144 |
| 8,241,454 | B2 | 8/2012 | Kraus et al. | |

FOREIGN PATENT DOCUMENTS

| | | | |
|---|---|---|---|
| CN | 101842233 | A | 9/2010 |
| CN | 102848605 | A | 1/2013 |
| CN | 102883966 | A | 1/2013 |
| CN | 103416846 | A | 12/2013 |
| DE | 14 07 416 | A1 | 10/1969 |
| EP | 2 620 062 | A2 | 7/2013 |
| EP | 2 666 624 | A1 | 11/2013 |
| JP | 47-005719 | A | 9/1972 |
| JP | 50-49500 | | 5/1975 |
| JP | 54-52799 | A | 4/1979 |
| KR | 10-2013-0064314 | A | 6/2013 |
| SU | 895714 | A1 | 1/1982 |
| WO | WO 2013/098353 | A1 | 7/2013 |
| WO | WO 2013/098356 | A1 | 7/2013 |

OTHER PUBLICATIONS

Kazak Office Action dated Mar. 1, 2017in Patent Application No. 2016/0297.1(with English translation).

International Search Report and Written Opinion dated Apr. 2, 2015 for PCT/EP2014/068445 filed on Aug. 29, 2014.

Combined Chinese Office Action and Search Report dated Oct. 26, 2018 in Chinese Patent Application No. 201480045902.5 (with English translation), 19 pages.

Office Action dated Sep. 3, 2018 in corresponding Japanese Patent Application No. 2016-537316 (with English Translation), 20 pages.

Decision to Grant dated Sep. 26, 2018 in corresponding Russian Patent Application No. 2016112300/12(019384) (with English Translation), 14 pages.

Notice of Allowance dated Jun. 6, 2019 in Japanese Patent Application No. 2016-537316 (with English translation), 4 pages.

European Office Action dated May 16, 2019 in European Patent Application No. 14758376.9, 6 pages.

* cited by examiner

METHOD AND APPARATUS FOR MANUFACTURING VARIABLE CRIMPED WEB MATERIAL

The present invention relates to a method of manufacturing variable crimped web material. The present invention also relates to the apparatus for manufacturing variable crimped web material. The present invention further relates to a method of manufacturing an air flow directing element for smoking articles.

Methods and apparatus for producing crimped web material for use in smoking articles are known in the art. The known methods of producing crimped web material involve interleaving rollers which produce a crimped web material having a substantially constant level of crimp along the length of the web material.

Methods and apparatus for forming air flow directing elements for smoking articles are also known. The known methods for producing such air flow directing elements having a variable resistance-to-draw along their length involve using multiple segments of differing resistance-to-draw. Using multiple segments increases the manufacturing complexity and cost of the air flow directing element.

It would be desirable to provide a method and apparatus for manufacturing crimped web material having a variable crimp along its length in a single operation. It would also be desirable to provide a simpler and more efficient method of manufacturing an air flow directing element.

According to the present invention there is provided a method of manufacturing variable crimped web material. The method comprises: feeding substantially continuous web material; crimping a first region of the web material at a first crimp value; and crimping a second region of the web material, adjacent the first region, at a second crimp value. The web material is crimped using a set of two rollers, each roller being corrugated across at least a portion of its width and corrugated around its circumference, the rollers being configured such that the corrugations across the width of the rollers interleave with each other to crimp the web material, and such that the troughs of the corrugations around the circumference crimp the web material at the first crimp value, and the peaks of the corrugations around the circumference crimp the web material at the second crimp value.

Providing such a method enables crimped web material to be formed which has regions of different crimp value along its length in a single operation.

In the preferred embodiment, the web material is paper, but any suitable web material, such as polylactide (PLA), polyester, bioplastic such as Mater-Bi®, or sheet tobacco may be used.

As will be appreciated, the method comprises using the set of two rollers that are interleaved to crimp web material as it is fed between the rollers. The rollers are corrugated both across their width and around their circumference to produce a crimped web material having regions of different crimp value.

The troughs of the corrugations around the circumference of the first roller are preferably substantially rotationally aligned with the troughs of the corrugations around the circumference of the second roller. Thus, it will be appreciated that the peaks of the corrugations around the circumference of the first roller are preferably substantially aligned with the peaks of the corrugations around the circumference of the second roller. The first roller and the second roller are offset in the longitudinal direction such that the corrugations in the longitudinal direction of the first roller and second roller are interleaved.

As used herein, the term 'crimp value' is defined as the ratio of two times the radius of the roller at the peaks of the corrugations to the distance between the axis of the first roller and the axis of the second roller. A crimp value of less than 1 refers to the case where the peaks of the corrugations do not overlap in the radial direction, and a crimp value of greater than 1 refers to the case where the peaks of the corrugations do overlap in the radial direction.

The corrugations around the circumference of each roller are preferably formed such that the angles, $\alpha$ and $\beta$, corresponding respectively to the angle of the sector formed by the axis of the roller and the trough of a corrugation, and the angle of the sector formed by the axis of the roller and the peak of a corrugation, conform to the equation $360/(\alpha+\beta)$ being an integer.

Conforming the rollers to have such corrugations enables the process to be continuous, and enables the length of each crimped region to be consistent.

The method may further comprise crimping a third region of the web material at a third crimp value. In this embodiment, the corrugations around the circumference of each roller comprise a peak section, a trough section, and a mid-section, each having a different radius.

When the rollers comprise a mid-section, the corrugations around the circumference of each roller are preferably formed such that angles, $\alpha$, $\beta$ and $\gamma$, corresponding respectively to the angle of the sector formed by the axis of the roller and the trough of the corrugation, the angle of the sector formed by the axis of the roller and the peak of a corrugation, and the angle of the sector formed by the axis of the roller and a mid-section of a corrugation, conform to the equation $360/(\alpha+\beta+\gamma)$ being an integer.

The method may further comprise detecting the interface between the different regions of crimp value, and cutting the web material at a location in dependence on the detected interface to form sections of crimped web material having a plurality of crimped regions. By detecting the interface between the different regions of crimp value, the crimped web material may be cut more accurately.

The crimped web material may be cut at the interface between the first region having first crimp value and the second region having a second crimp value. Alternatively, the crimped web material may be cut at a location along the first region. Preferably, the web material is cut such that the first region is divided into two portions having substantially the same length.

In the embodiment where the crimped web material is cut into sections, each section may comprise at least one region having a first crimp value and at least one region having a second crimp value. Preferably, each section comprises between one and eight regions having a first crimp value, and between one and eight regions having a second crimp value.

In a preferred embodiment, the crimped web material is cut such that it comprises five first regions having a first crimp value and four second regions having a second crimp value, arranged such that the region at a first end of the cut crimped web material section is a first region, and the region at a second end of the cut crimped web material section is a first region. In this preferred embodiment, the regions at the first end and second end are each preferably half of the length of an uncut first region.

The present invention also relates to an apparatus for use in manufacturing variable crimped web material. The apparatus comprises: a set of rollers comprising a first roller and a second roller. Each roller is corrugated across its width and corrugated around its circumference, the rollers are configured such that the corrugations across the width of the rollers interleave with each other, and such that the troughs of the corrugations around the circumference are configured to crimp web material at a first crimp value, and the peaks of the corrugations around the circumference are configured to crimp the web material at a second crimp value.

The troughs of the corrugations around the circumference of the first roller are preferably substantially aligned with the troughs of the corrugation around the circumference of the second roller. Thus, it will be appreciated that the peaks of the corrugations around the circumference of the first roller are preferably substantially aligned with the peaks of the corrugations around the circumference of the second roller.

The radius of the rollers in the region of the peaks of the corrugations around the circumference of the rollers is designated by $r_1$. The radius of the rollers in the region of the troughs of the corrugations around the circumference of the rollers is designated by $r_2$. The radius of the rollers in the region of the troughs of the corrugations across the width of the rollers is designated by $r_3$. The distance between the axis of the first roller and the axis of the second roller is designated by X.

To avoid interference between the rollers during operation, the radiuses, and distance between the roller axes preferably conform to the following equation:

$$r_1<X-r_3$$

Thus the minimum clearance between the rollers, designated as C, is provided by the following equation:

$$C=X-r_1-r_3$$

As described above, the crimp value is defined as the ratio of two times the radius of the roller at the peaks of the corrugations to the distance between the axis of the first roller and the axis of the second roller. As such, the crimp values are provided by the following equations:

$$\text{first crimp value}=2r_2/X$$

$$\text{second crimp value}=2r_1/X$$

The thickness of a crimp element of the roller is designated as $t_1$. The distance between each crimp element is designated as $t_2$. Preferably, the thickness $t_1$ is less than the distance $t_2$ The thicknesses $t_1$ and $t_2$ are measured along the axial direction of the roller.

The corrugations around the circumference of each roller are preferably formed such that the angles, α and β, corresponding respectively to the angle of the sector formed by the axis of the roller and the trough of a corrugation, and the angle of the sector formed by the axis of the roller and the peak of a corrugation, conform to the equation $360/(\alpha+\beta)$ being an integer.

The lateral distance between the axes of the rollers is designated as D. In a preferred embodiment, D equals zero, and as such the axes of the rollers are substantially vertically aligned.

By controlling the parameters $r_1$, $r_2$, $r_3$, C, $t_1$, $t_2$, D, α, and β, the crimp values applied to the web material can be controlled.

In a preferred embodiment, the radius $r_1$ is between about 80 mm and about 120 mm, more preferably between about 90 mm and about 110 mm, most preferably about 99.3 mm. The radius $r_2$ is between about 80 mm and about 120 mm, more preferably between about 90 mm and about 110 mm, most preferably about 98.5 mm. The radius $r_3$ is between about 80 mm and about 120 mm, more preferably between about 90 mm and about 110 mm, most preferably about 98.3 mm. The clearance C is between about 0.3 mm and about 0.9 mm, more preferably between about 0.5 mm and about 0.7 mm, most preferably about 0.6 mm. The thickness $t_1$ is between about 0.8 mm and about 1.2 mm, more preferably between about 0.9 mm and about 1.1 mm, most preferably about 1.0 mm. The distance $t_2$ is between about 1.0 mm and about 1.4 mm, more preferably between about 1.1 mm and about 1.3 mm, most preferably about 1.2 mm. The angle α is between about 7 degrees and about 9 degrees, more preferably between about 7.5 degrees and about 8.5 degrees, most preferably about 8.1 degrees. The angle β is between about 6 degrees and about 8 degrees, more preferably between about 6.5 degrees and about 7.5 degrees, most preferably about 6.9 degrees.

Conforming the rollers to have such corrugations enables the process to be continuous, and enables the length of each crimped region to be consistent.

The peaks of the corrugations around the circumference of each roller are preferably provided with rounded edges. By providing rounded edges the stresses applied to the web material during crimping may be reduced, and as such the risk of breaking the web material may be reduced.

The corrugations as seen in the transverse cross-section of the roller may form a square wave profile, a sinusoidal wave profile, or a triangular profile. The peaks of the corrugations as seen in the transverse cross-section of the roller may be rounded. By providing rounded edges the stresses applied to the web material during crimping may be reduced, and as such the risk of breaking the web material may be reduced. In a preferred embodiment, the corrugations as seen in the transverse cross-section of the roller form a square wave profile.

Each roller may be configured to crimp web material at a third crimp value. In this embodiment, the corrugations comprise a peak section, a trough section, and a mid-section, each having a different radius.

When the rollers comprise a mid-section, the corrugations around the circumference of each roller are preferably formed such that angles, α, β and γ, corresponding respectively to the angle of the sector formed by the axis of the roller and the trough of the corrugation, the angle of the sector formed by the axis of the roller and the peak of a corrugation, and the angle of the sector formed by the axis of the roller and a mid-section of a corrugation, conform to the equation $360/(\alpha+\beta+\gamma)$ being an integer.

The apparatus may comprise means for detecting the interface between the regions of different crimp value. The detecting means may comprise an optical detector, such as a camera, coupled to a processor configured to determine the interface between the regions of different crimp value.

The apparatus preferably comprises cutting means for cutting the crimped web material into sections. The cutting means is preferably controlled by the detecting means to ensure that the crimped web material is cut in the correct location. The cutting means may be any cutter suitable for cutting web material, or other such material being crimped, and may comprise a knife, such as a flying-knife.

The cutting means may be configured to cut the web material at an interface between a first region having a first crimp value and a second region having a second crimp value. In a preferred embodiment, the cutting means is preferably configured to cut the crimped web material at a location along a first region having a first crimp value. More preferably, the cutting means is configured to cut the crimped web material such that the first region is divided into two portions having substantially the same length.

Alternatively, or in addition to the detecting means, the apparatus may comprise means for synchronising the cutting means to the crimping rollers. By synchronising the cutting means to the crimping rollers, the crimped web material may be cut in substantially the same relative position each time. The synchronising means may comprise gears to link the cutting means to the crimping rollers.

The crimped web material may be cut into various lengths having various combinations of first regions and second regions as described above.

The crimping rollers may be manufactured by machining the corrugations onto a cylindrical roller.

According to the present invention, there is further provided a method of manufacturing an air flow directing element for a smoking article. The method comprises: feeding substantially continuous web material; alternately crimping, along the feed direction, the web material at a first crimp value, then at a second crimp value, using a set of two rollers, each roller being corrugated across its width and corrugated around its circumference, the rollers being configured such that the corrugations across the width of the rollers interleave with each other to crimp the web material; providing a substantially continuous substantially air impermeable hollow body; gathering the crimped web material around the substantially air impermeable hollow body; wrapping the gathered crimped web material in wrapper material to form a substantially continuous air flow directing element; and cutting the substantially continuous air flow directing element to form discrete sets of air flow directing elements, each air flow directing element comprising at least one region being crimped at the first crimp value and at least one region being crimped at the second crimp value. The hollow body is preferably a substantially air impermeable hollow tube.

Advantageously, providing such a method enables air flow directing elements to be made more easily than using multiple segments, each segment being made separately.

Preferably, the region of the air flow directing element being crimped at the first crimp value has a resistance-to-draw of between about 50 $mmH_2O$ and about 70 $mmH_2O$, and the region of the air flow directing element being crimped at the second crimp value has a resistance-to-draw of between about 140 $mmH_2O$ and about 220 $mmH_2O$. Preferably, each region having a different crimping value has a different resistance-to-draw. The resistance to draw is measured in accordance with ISO 6565:2011 and is typically expressed in units of $mmH_2O$. The resistance to draw of the each region having a different crimp value may be measured by cutting the air flow directing element such that is comprises only the region to be measured, and drawing on one end of the air flow directing element while the hollow portion of the airflow directing element is sealed such that air flows only through the air-permeable portion of the airflow directing element.

In a particularly preferred embodiment, the air flow directing element comprises three crimped regions. Each air flow directing element preferably comprises a first region being crimped at the first crimp value, a second region, adjacent the first region, being crimped at the second crimp value, and a third region, adjacent the second region, being crimped at the first crimp value. As such, each air flow directing element is preferably substantially symmetrical about the mid-point along its length. By providing a substantially symmetrical air flow directing element it may more easily be combined with other components to form a smoking article as the orientation of the air flow directing element during the smoking article manufacturing process is not important.

In this particularly preferred embodiment, the first crimped region and the third crimped region each have a longitudinal length of between about 5 mm and about 10 mm, more preferably between about 6 mm and about 8 mm, and most preferably about 7 mm. The first region and the third region being crimped at a first crimp value such that the resistance-to-draw of each region is between about 45 $mmH_2O$ and about 65 $mmH_2O$, more preferably between about 50 $mmH_2O$ and about 60 $mmH_2O$, and most preferably about 56 $mmH_2O$. The second region having a longitudinal length of between about 7 mm and about 17 mm, more preferably between about 10 mm and about 14 mm, and most preferably about 12 mm. The second region being crimped at a second crimp value such that the resistance-to-draw of the region is between about 150 $mmH_2O$ and about 190 $mmH_2O$, more preferably between about 160 $mmH_2O$ and about 180 $mmH_2O$, and most preferably about 168 $mmH_2O$. It will be understood that this is only one example of a preferred embodiment, and that the present invention may comprise regions having various lengths and having various resistances-to-draw as described herein.

Each set of air flow directing elements preferably comprises four air flow directing elements. The air flow directing elements may then be used in further manufacturing process to form aerosol generating articles, such as smoking articles.

In one embodiment, the length of the air flow directing element is between about 15 mm and about 60 mm, preferably between about 20 mm and about 45 mm, and in one particularly preferred embodiment the length of the air flow directing element is about 26 mm.

In another embodiment, the length of the air flow directing element is about 21 mm. In this embodiment, the length each of the first region, second region and third region is about 7 mm. The resistance-to-draw of the first region and the second region is about 56 $mmH_2O$ and the resistance-to-draw of the second region is about 98 $mmH_2O$.

The width of the web material used to form the crimped air-permeable segment is preferably between about 150 mm and about 250 mm.

As will be understood, the present invention may be used to crimp any suitable web material, especially materials suitable for forming segments of smoking articles. Such suitable materials include, but are not limited to paper, polylactide (PLA), polyester, bioplastic such as Mater-Bi®, and sheet tobacco.

According to a yet further aspect of the present invention, there is provided a roller for use in manufacturing variable crimped web material, the roller being corrugated across its width and corrugated around its circumference.

According to a yet further aspect of the present invention, there is provided a kit of rollers for use in manufacturing variable crimped web material, the kit comprising at least two rollers as described herein.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
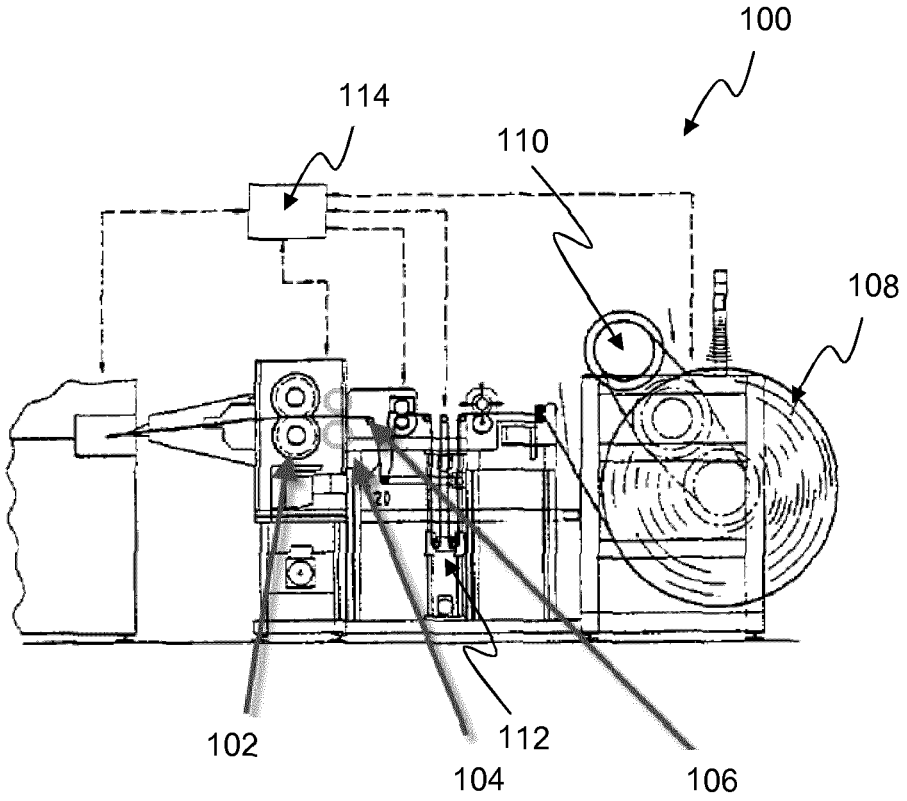
FIG. 1 shows a side view of an apparatus for manufacturing variable crimped paper.

FIG. 1 shows apparatus 100 for manufacturing variable crimped paper. The apparatus comprises, among other components, interleaved longitudinal crimping rollers 102, and/or variable crimping rollers 104. In a preferred example, the interleaved longitudinal crimping rollers 102 are replaced by the variable crimping rollers 104. The apparatus further comprises a lateral sheet cutting mechanism 106 configured to cut the paper to the required width before it is crimped by the rollers. A bobbin of sheet web material 108, such as paper, is provided and fed into the crimping rollers. The drive and brake mechanism 110 feeds the sheet web material from the bobbin 108. The mechanism 112 ensures that the web material enters the crimping rollers at the desired tension. Control electronics 114 are provided to control the system during operation.

The variable crimping rollers 104 comprise a set of two interleaved rollers. Each crimping roller is corrugated across its width, and also corrugated around its circumference. The crimping rollers are synchronised with each other to ensure that the corrugations around the circumference of the rollers remain aligned.

In use, the crimping rollers force the web material between the interleaved corrugations, which deforms the web material to form the crimp. Crimping the web material reduces the effective width of the web material, and increases the effective thickness of the web material. The crimped web material can then be gathered together and used to form air flow directing elements as described below. Controlling the crimp value of the crimped web material can be used to control the resistance-to-draw of the air flow directing element. Increasing the crimp value increases the resistance-to-draw.

Figure 2:
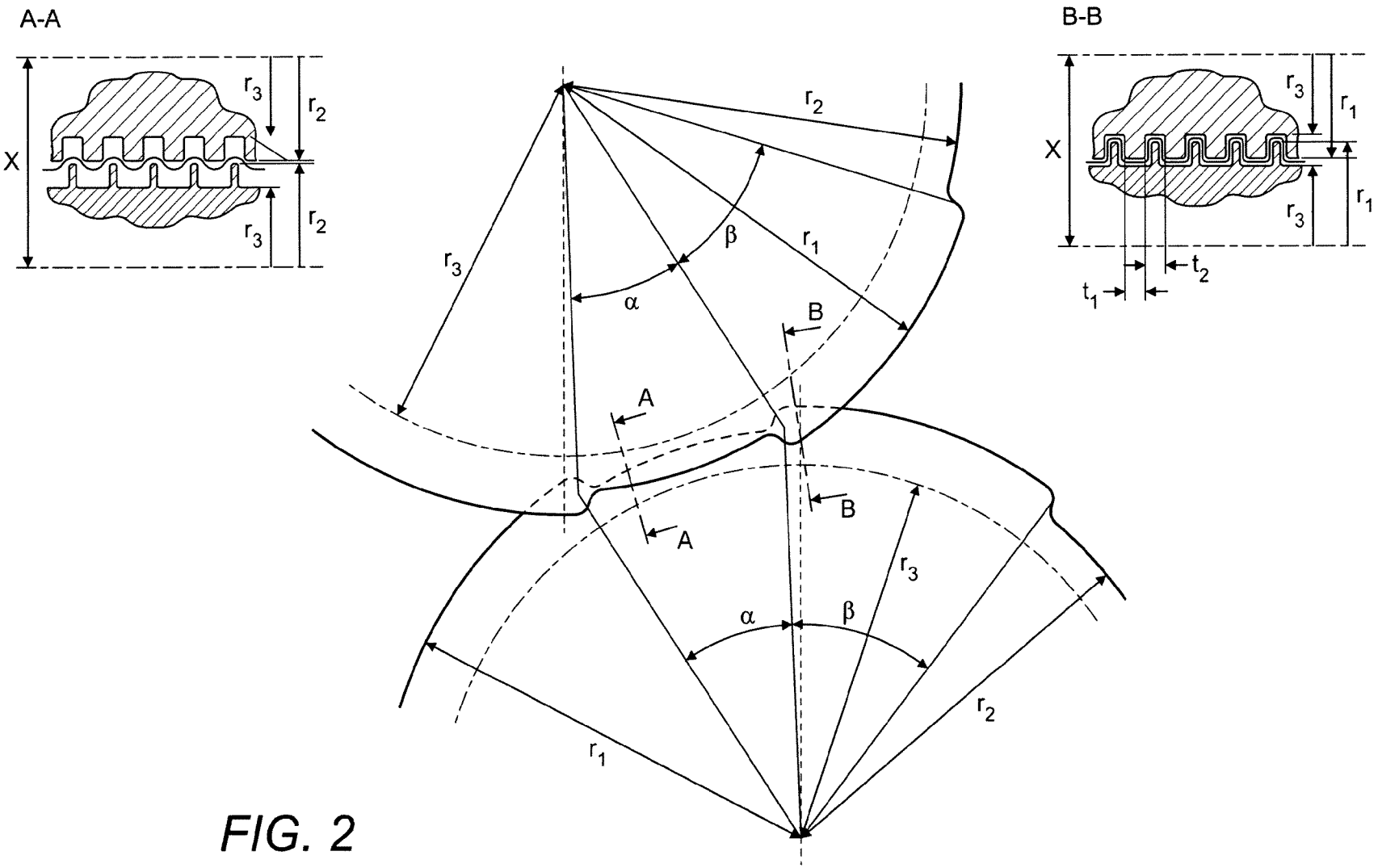
FIG. 2 shows a schematic cross-section of interleaved rollers used to variably crimp paper.

FIG. 2 shows a cross-sectional view of a section of the crimping rollers used to variably crimp the web material. Each roller is corrugated around the circumference. The troughs of the corrugation have an arc angle $\alpha$, and the peaks of the corrugations have an arc angle $\beta$. The rollers are configured such that the formula $360/(\alpha+\beta)$ is an integer. That is to say, each peak around the circumference of the roller has the same arc length as the other peaks, and each trough around the circumference of the roller has the same arc length as the other troughs. By configuring the rollers in this way the web material can be crimped continuously and provide regions having different crimp values with consistent lengths throughout the continuous operation. The peaks and troughs of the rollers are aligned during use so that different crimp values are applied alternately to the web material as it passes between the rollers.

Section B-B shows a cross-section of the interleaved rollers at the peaks of the corrugations. As can be seen, the crimping roller also has corrugations across the width of the roller. The internal radius of the roller, that is the radius at the troughs of the corrugations across the width of the roller, is shown as $r_3$, and the radius of the peaks of the corrugations across the width of the roller is shown as $r_1$. As such, the radius $r_1$ corresponds to the radius of the peaks of the corrugations around the circumference of the roller. The distance X which is the distance between the axes of the rollers, together with the radiuses $r_3$ and $r_1$, are controlled to determine the crimp value applied to the web material.

Section A-A shows a cross-section of the interleaved rollers at the troughs of the corrugations. Similarly to Section B-B, the internal radius of the roller, that is the radius at the troughs of the corrugations across the width of the roller, is shown as $r_3$, and the radius of the peaks of the corrugations across the width of the roller is shown as $r_2$. As such, the radius $r_2$ corresponds to the radius of the troughs of the corrugations around the circumference of the roller. The distance X, together with the radiuses $r_2$ and $r_1$ are controlled to determine the crimp value applied to the web material.

Furthermore, the thickness, $t_1$, of each crimping element having corrugations around the circumference, and the distance, $t_2$, between each crimping element may also be used to control the crimp value. In addition, the rollers may be offset from vertical alignment, the value of the offset, D, may also be used to determine the crimp value.

As will be appreciated, and as shown in FIG. 2, the radiuses $r_1$ ad $r_2$ correspond to the radius of the peaks of the corrugations around the circumference of the roller and the troughs of the corrugations around the circumference of the roller respectively.

In one particular example, the various parameters have the following values:

$r_1$=99.3 mm
$r_2$=98.8 mm
$r_3$=98.3 mm
X=198.2 mm
C=0.6 mm
$\alpha$=8.07°
$\beta$=6.92°
D=0
$t_1$=1 mm
$t_2$=1.2 mm
first crimp value=0.997
second crimp value=1.002

In a further particular example, the various parameters have the following values:

$r_1$=80.2 mm
$r_2$=79.7 mm
$r_3$=79.2 mm
X=160 mm
C=0.6 mm
$\alpha$=5°
$\beta$=2.5°
D=0
$t_1$=1 mm
$t_2$=1.2 mm
first crimp value=0.996
second crimp value=1.003

Finally, as shown in FIG. 2, the peaks of the corrugations have rounded corners to reduce the stress applied to the web material during crimping, and therefore the risk of breaking the web material is reduced.

By corrugating the crimping rollers around the circumference of the rollers, alternate crimp values can be applied to the web material. The first crimped region corresponding to the region of web material crimped at the first crimp value by the troughs of the corrugations around the rollers is approximately $r_2 \cdot \alpha$ in length. The second crimped region corresponding to the region of web material crimped at the second crimp value by the peaks of the corrugations around the rollers is approximately $r_1 \cdot \beta$ in length. To determine the length of the first and second crimped regions herein, $\alpha$ and $\beta$ are in radians.

Figure 3:
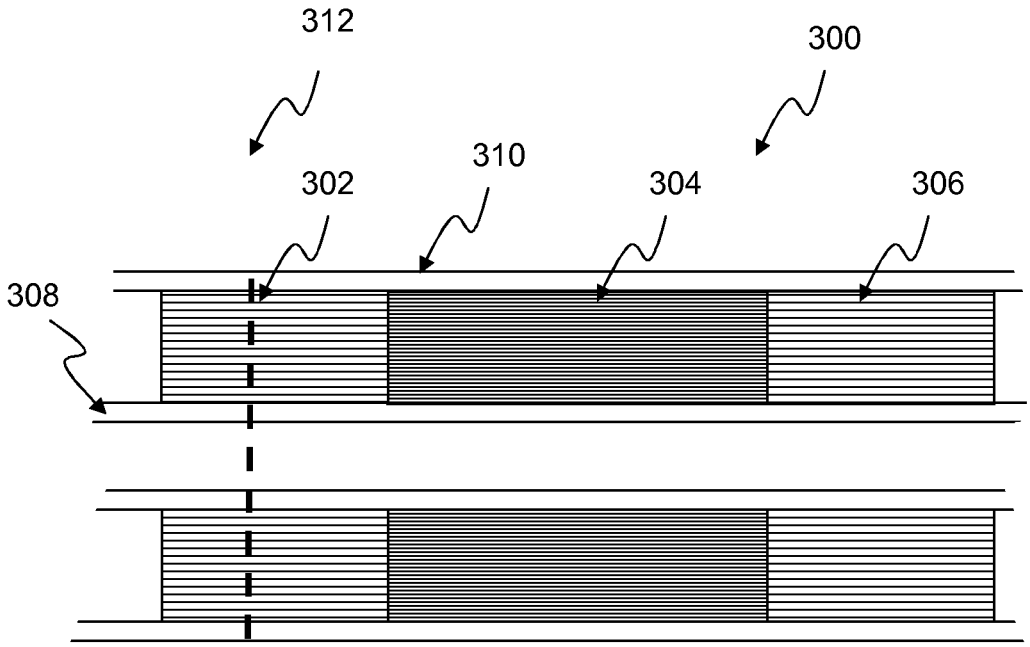
FIG. 3 shows a cross-sectional view of an air flow directing element having variable resistance-to-draw along its length.

FIG. 3 shows an air flow directing element 300 formed using the crimped web material manufactured as described above. The air flow directing element comprises a series of regions 302, 304 and 306, and a hollow tube 308 at the centre of the air flow directing element. The air flow directing element is wrapped in a substantially air-impermeable wrapper 310. The wrapper 310 is provided with perforations 312 which act as air inlets when the air flow directing element is used in a smoking article.

To form the air flow directing element, the crimped web material is gathered together around the hollow tube 308, and then wrapped in the substantially air-impermeable wrapper 310.

The region 302 corresponds to a half length first region having a first crimping value, the region 304 corresponds to a full length second region having a second crimping value, and region 306 corresponds to a half length first region having a first crimping value. As will be appreciated, the air flow directing element is thus symmetrical about a transverse centre line. Forming a symmetrical air flow directing element reduces the complexity of later smoking article manufacture as the orientation of the air flow directing element is not relevant.

The substantially continuous crimped web material having alternating regions of a first crimp value and a second crimp value is cut into suitable lengths. In the preferred embodiment, the crimped web material is cut to such a length that each section comprises web material sufficient for four air flow directing elements. The crimped web material is cut such that the first region is divided substantially equally, so that each crimped web material section comprises a half length first region, then four full length second regions with full length first regions provided in between, and then a final half length first region. In this way, the crimped web material section can be used to form a so-called four-up air flow directing element for later use in manufacturing smoking articles.

The measured resistance-to-draw of each region of a particularly preferred embodiment of the air flow directing element are as follows: about 56 $mmH_2O$ for first the half length first region; about 168 $mmH_2O$ for the full length second region; and about 56 $mmH_2O$ for the second half length first region. The longitudinal lengths of each region of a particularly preferred embodiment of the air flow directing element are as follows: about 7 mm for first the half length first region; about 12 mm for the full length second region; and about 7 mm for the second half length first region.

The invention claimed is:

1. An apparatus for manufacturing a variable crimped web material, comprising:

a set of rollers comprising a first roller and a second roller, wherein each roller is corrugated across its width, each roller is corrugated around its circumference to alternate between peak sectors and trough sectors, the first and second rollers are configured such that corrugations across the width of the rollers interleave with each other, the peak sectors of the first roller are circumferentially aligned with the peak sectors of the second roller, the trough sectors of the first roller are circumferentially aligned with the trough sectors of the second roller, the first and second rollers are configured to crimp web material between the trough sectors at a first crimp value, and the first and second rollers are configured to crimp the web material between the peak sectors at a second crimp value that is larger than the first crimp value, the first crimp value and the second crimp value being defined as follows:

the first crimp value$=2r_2/X$, and the second crimp value$=2r_1/X$, wherein $r_2$ is an outermost radius of the first and second rollers in the trough sectors, $r_1$ is an outermost radius of the first and second rollers in the peak sectors, and X is a distance between an axis of the first roller and an axis of the second roller:

means for detecting an interface between regions of different crimp value on the web material; and cutting means for cutting the crimped web material into sections, the cutting means being controlled by the means for detecting.

2. The apparatus according to claim 1, wherein the corrugations around the circumference of said each roller are formed such that angles $\alpha$ and $\beta$, corresponding respectively to an angle of one of the trough sectors formed by the axis of said each roller and a trough of a corrugation, and an angle of one of the peak sectors formed by the axis of said each roller and a peak of a corrugation, conform to an equation: $360/(\alpha+\beta)$=an integer.

3. The apparatus according to claim 1, wherein the peak sectors of the corrugations around the circumference of said each roller are provided with rounded edges.

4. The apparatus according to claim 1, wherein said each roller is configured to crimp the web material at a third crimp value.

5. The apparatus according to claim 1, wherein the set of rollers is a kit of rollers comprising at least two rollers.

6. The apparatus according to claim 1, wherein in the trough sectors, peaks of the first roller are separated from corresponding troughs of the second roller by a first distance, in the peak sectors, peaks of the first roller are separated from corresponding troughs of the second roller by a second distance, and the first distance is greater than the second distance.

* * * * *